US005448842A

United States Patent [19]

Sonstroem

[11] Patent Number: 5,448,842

[45] Date of Patent: Sep. 12, 1995

[54] ENCLOSURE SIGN DEVICE

[75] Inventor: Jaime Sonstroem, Springfield, Va.

[73] Assignee: The United States of America as represented by the Secretary of the Army, Washington, D.C.

[21] Appl. No.: 214,528

[22] Filed: Mar. 18, 1994

[51] Int. Cl.[6] ..... G09F 3/18

[52] U.S. Cl. ..... 40/331; 40/584; 70/159; 70/416

[58] Field of Search ..... 40/331, 584, 312, 617, 40/642; 312/245; 70/448, 455, 209, 416, D58, 159, 160

[56] References Cited

U.S. PATENT DOCUMENTS

| | | | |
|---|---|---|---|
| 3,180,473 | 4/1965 | Garvey | 70/159 |
| 3,414,306 | 12/1968 | Bernstein | 70/416 |
| 4,108,227 | 8/1978 | Bonner | 40/661 X |
| 4,703,850 | 11/1987 | Walker | 206/293 X |
| 4,799,370 | 1/1989 | Cooper | 70/159 X |
| 4,897,945 | 2/1990 | Webb | 40/331 X |

*Primary Examiner*—Brian K. Green
*Assistant Examiner*—James O. Hansen
*Attorney, Agent, or Firm*—Milton W. Lee; John E. Holford; Alain L. Bashore

[57] ABSTRACT

Enclosure sign device for unavoidable viewing of a sign before manipulation of an entryway opening device. An enclosure of an entryway opening device includes at least one side surface extending out at least as far as the entryway opening device, a back surface coupled to the side surface to accommodate the entryway opening device through the back surface, and a front surface releasably coupled to the side surface which can be releasably opened or closed over the entryway opening device. The enclosure is coupled to a surrounding surface of the entryway opening device and includes a display for releasably holding a sign attached to the outside surface of the front surface so that sign viewable when the front surface is closed. Access is obtained to an entryway opening device by releasably opening the latching so that there is unavoidable viewing of a sign before manipulation of the entryway opening device.

1 Claim, 1 Drawing Sheet

ENCLOSURE SIGN DEVICE

BACKGROUND OF THE INVENTION

1. Field of the Invention

The present invention generally relates to warning sign devices and more specifically, to an enclosure sign device for unavoidable viewing of a sign before manipulation of an entryway opening device.

2. Description of Prior Art

The prior art is replete with various safety devices utilized to advise others of information. A lighted or unlighted sign is the most commonly used device, which may be used for such concerns as a warning, exit, or directional information. When the information conveyed by the sign is only intermittently in effect, the sign is then usually selectively illuminated. A visual indicator light is also another commonly utilized device to convey information, which is known in a wide range of varieties from a bare bulb to sophisticated lighting systems. While these types of devices are useful, there is disadvantages inherent with the use of the above described illuminated signs and visual indicator lights.

The typical sign is either positioned flat on a wall or at a ninety degree angle. This positioning restricts the viewing angle to approximately full side or frontal approaches. It is important that the sign be at least partially visible at all approaches or there may occur a failure to heed what a sign conveys. Light bulbs that illuminate from within an enclosure which includes a sign are prone to frequent failure because of poor heat convection. Frequently the sign is fixedly mounted and not interchangeable with other signs.

Visual indicator lights are particularly effective in high ambient noise areas and come in various revolving or strobe styles. A visual indicator light does not have restricted viewing angles, but lacks conveying all but the basic of information, such as "stay away". There are many incidents that require specific information, such as "goggles required" when a particular machine is in use. Unless a person is familiar with the exact meaning of a "flashing" light there again may occur a failure to heed what a light itself conveys.

While the prior art has reported using safety sign devices none have established a basis for a specific device that is dedicated to the task of resolving the particular problem at hand. What is needed in this instance is a safety sign device that is unavoidably viewable before entry through a closed door entryway.

SUMMARY OF THE INVENTION

It is therefore one object of the invention to provide a safety sign device with interchangeable sign capability, that is unavoidably viewable before entry through an entryway.

According to the invention, there is disclosed an enclosure sign device for unavoidable viewing of a sign before manipulation of an entryway opening device. An means for enclosure of an entryway opening device includes at least one side surface extending out at least as far as the entryway opening device, a back surface coupled to the side surface to accommodate the entryway opening device through the back surface, and a front surface releasably coupled to the side surface which can be releasably opened or closed in front of the entryway opening device. The enclosure is coupled to a surrounding surface of the entryway opening device and includes a display means for releasably holding a sign attached to the outside surface of the front surface so that the sign is viewable when the front surface is closed.

The display means includes a pane frame which surrounds, and is coupled on three sides to a pane. The pane includes a notch so that an appropriately sized sign may be slidingly inserted between the pane and the front surface. A notch allows a grip access to the sign for interchangeability. Access is obtained to an entryway opening device by releasably opening a means for latching so that there is the unavoidable viewing of a sign before manipulation of the entryway opening device.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
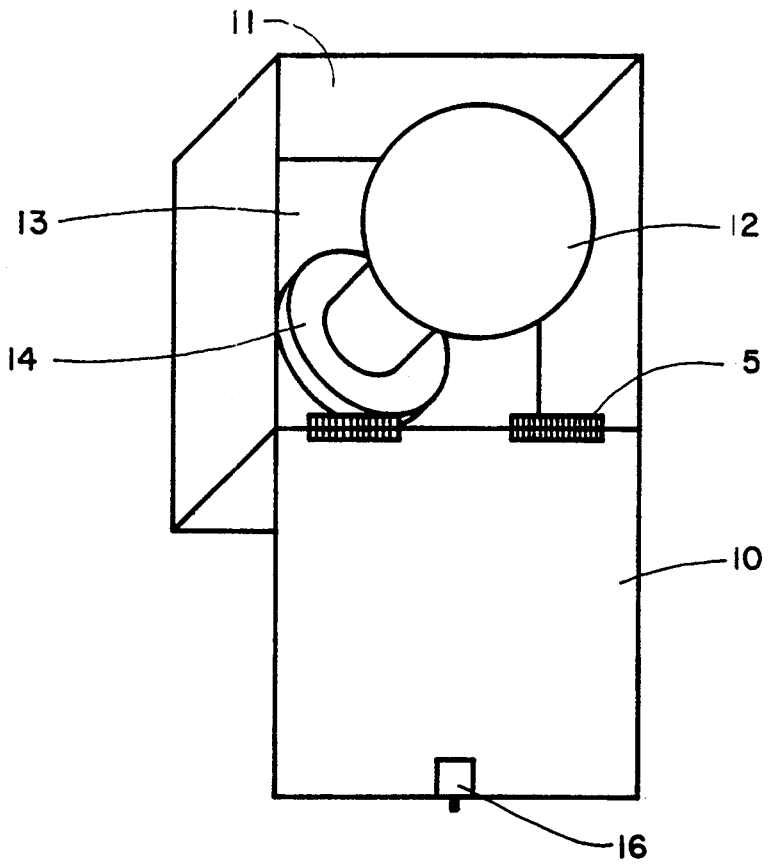
FIG. 1 is an oblique front view of the safety sign device with opened access door.

Referring now to the drawings, and more particularly to FIG. 1, there is shown the safety sign device of the present invention including an means for enclosure shown as a housing with opened access door 10. The housing includes sides 11 shown as surrounding on four sides doorknob 12. Back 13 of the assembly housing includes a hole with the approximate diameter as the doorknob access hole such that doorknob plate 14 of the door will hold the housing flush with the door surface, and positioned concentrically about doorknob 12. While the above coupling technique is utilized in the described embodiment it is understood that other coupling techniques such as protruding flanges from sides 11 with common screws to couple to the door surface may be used. Access door 10 includes hinge 15 (one of two shown) and latching means 16 such that access door 10 may be swung opened as shown in FIG. 1. It is understood that while the present embodiment is utilized as enclosing a doorknob, any entryway opening device may by utilized with the present invention.

Figure 2:
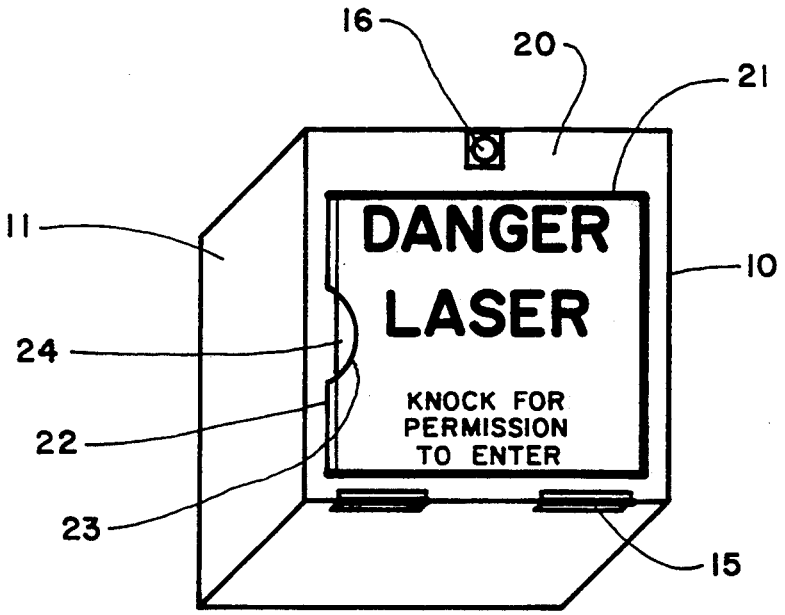
FIG. 2 is an oblique front view of the safety sign device with closed access door.

FIG. 2 depicts the safety sign device including access door 10 in a closed position with a front surface 20 showing in outward appearance. On front surface 20 is a display means that includes pane frame 21 which surrounds, and is coupled on three sides to pane 22. Pane 22 includes notch 23 so that an appropriately sized sign, such as sign 24, which may be slidingly inserted between pane 22 and front surface 20. Notch 23 allows a grip access to sign 24 for replacement or repair. It is understood that any type of transparent material of suitable strength and protection may be used as pane 22 so as to protect sign 24 from the outside elements. Sign 24 shown is the sign utilized in the present embodiment. It is understood that any sign utilized which is desired to convey a message to a person before the door is opened may be used.

The material for constructing the box would be plastic, but other acceptable materials would be metal, wood, or a stiff cardboard. Any material which serves the purpose of the device would be acceptable. The type of latch would be any which disengages when the front knob is pulled, such as magnetic or of a mechanical variety.

In the present embodiment the safety sign device is physically coupled to a door entrance to a room within which is located laser equipment. When the laser equipment is operated, the operator and all occupants must take proper eye safety precaution. The access door 10 is left open as shown in FIG. 1 when lasers are not operating in the room. When lasers are in operation, access door 10 is closed as shown in FIG. 2, displaying the warning sign 24 as shown. The access door can be opened via latching means 16 which is a simple latch in the present embodiment. Latching means 16 is not in a locked state so that the room may be entered in case of an emergency. However, no one can enter the room without opening the access door and therefore observing the safety sign 24. Sign 24 is then seen which therefore alerts those outside the door that a safety hazard currently is in effect.

The present embodiment is shown in both FIGS. 1 and 2 as cubical for the general enclosure shape, but the invention is not limited to such. A cylindrical tube-like enclosure with a flat circular hatch would be effective, while certain shapes such as an octagonal enclosure reminiscent of a "stop sign" may also be used. The latch itself could be designed such that there is required a reading of a simple instruction to operate, thus another step that requires the unavoidable notice of the warning sign.

While this invention has been described in terms of preferred embodiment consisting of a safety sign for use outside a room containing laser equipment, those skilled in the art will recognize that the invention can be practiced with modification within the spirit and scope of the appended claims.

Having thus described my invention, what I claim as new and desire to secure by Letters Patent is as follows:

1. An enclosure device for unavoidable viewing of a sign before manipulation of an entryway opening device including:

means for enclosure of an entryway opening device, the means for enclosure including at least one side surface extending out at least as far as the entryway opening device, a back surface coupled to the side surface apertured to accommodate the entryway opening device therethrough the back surface, and a front surface coupled to the side surface which can be releasably opened or closed over the entryway opening device;

means for coupling the means for enclosure about the entryway opening device;

display means for releasably holding a sign, the display means coupled to the front surface;

means for latching the front surface such that access is obtained to an entryway opening device by releasably opening the means for latching so that there is unavoidable viewing of an interchangeable sign viewable on the front surface before manipulation of an entryway opening device.

* * * * *